United States Patent [19]

Johnson

[11] 4,140,573

[45] Feb. 20, 1979

[54] STOCK FORMATION IN A PAPER MAKING PROCESS

[75] Inventor: Henry Johnson, Montreal, Canada

[73] Assignee: JWI Ltd., Montreal, Canada

[21] Appl. No.: 738,154

[22] Filed: Nov. 2, 1976

[30] Foreign Application Priority Data

Nov. 6, 1975 [GB] United Kingdom ..... 46006/75

[51] Int. Cl.[2] ..... D21F 1/20; D21F 1/52

[52] U.S. Cl. ..... 162/209; 162/217; 162/352; 162/374

[58] Field of Search ..... 162/209, 217, 308, 352, 162/355, 374

[56] References Cited

U.S. PATENT DOCUMENTS

| | | | |
|---|---|---|---|
| 1,917,098 | 7/1933 | Cofrin | 162/209 |
| 3,102,066 | 8/1963 | Justus | 162/209 |
| 3,743,574 | 7/1973 | Walser et al. | 162/352 |
| 3,874,998 | 4/1975 | Johnson | 162/209 X |
| 3,922,190 | 11/1975 | Cowan | 162/352 |

*Primary Examiner*—Richard V. Fisher

*Attorney, Agent, or Firm*—Swabey, Mitchell, Houle, Marcoux & Sher

[57] ABSTRACT

The paper-making stock on a paper machine is improved by running the forming fabric, carrying the stock, as a layer of a dilute aqueous dispersion of fibers, over a modified low-vacuum suction box having a slotted cover made up of elongated blades dividing the suction area into a grid. The surfaces of some of the blades support the fabric and the surfaces of others are lowered a small amount to allow the fabric to undulate and agitate the stock without substantially changing the grid area cf the drainage surface. The lower level surfaces form a fluid seal with the undersurface of the fabric.

8 Claims, 9 Drawing Figures

A
B
W
6
6a
9
10
13
14
16
17
18
19
20
21
2
34
36
37
S
R
VI
VIII
IX

STOCK FORMATION IN A PAPER MAKING PROCESS

BACKGROUND OF THE INVENTION

1. Field of the Invention

This invention relates to a process and apparatus for improving the formation of the stock in a paper machine.

In the operation of the typical Fourdrinier paper making machine, a thin suspension of stock fibers in water is flowed from a head box slice onto the upper surface of a moving endless woven screen belt (Fourdrinier wire or fabric) made of metal or plastic material. The fabric passes over a breast roll at one end of the forming section of the machine, and a couch roll at the other. As the fabric travels in contact with spaced-apart transverse dewatering supports (table rolls, foils or blades) and over suction boxes located between the breast and couch rolls, water is withdrawn from the stock through the fabric leaving a thin self-supporting formation of matted fibers on the upper surface. This sheet of formed fibers is lifted off the fabric at the couch roll, at the downstream end of the forming section, and the belt, after travelling around the couch roll, is returned through a series of return rolls to the upstream end of the forming section where it travels around the breast roll and again passes under the slice to complete the cycle.

The paper mill stock supplied to the forming fabric of the machine is made up of fibers and solids in an aqueous suspension containing generally from about 99% to 99.5% water. Despite attempts to thoroughly mix the stock in the head box of the paper machine so that the fibers will be uniformly dispensed, the fibers invariably tend to agglomerate as they emerge from the slice and are deposited on the fabric in clumps or flocs. If these flocs of fibers remain undispersed the finished paper will not be of uniform density. Normally, the fibers tend to remain oriented horizontally. Also, as the stock layer advances through its dewatering path, while the lower strata are drawn ahead by frictional forces acting between them and the forming fabric, the upper strata are less influenced and, through inertia, tend to cause the fibers to form laminae in the stock.

2. Description of the Prior Art

Several methods have been tried to redistribute fibers in the stock after it has been transferred to the forming fabric and during the early stages of dewatering. Some such methods employ mechanical means for shaking components of the machine either laterally or vertically. Others employ air or water jets playing on the stock layer. Usually all these methods have some disadvantage or other.

While it is desirable, in some cases, to provide some means of shaking the stock horizontally in the cross machine or transverse direction, it is also important to provide some rapid vertical displacement to make use of surface instabilities in the wet stock and the resulting shear forces set up within the stock suspension to cause redistribution of fibers. Normally vertical displacement is caused, in the conventional drainage table of a paper machine, by the creation of vacuum as the fabric leaves the supporting surfaces of table rolls or foils. This vacuum forces the Fourdrinier fabric to deflect vertically at the downstream sides of these components thereby causing vertical undulation of the fabric as it passes from one roll or foil to another roll or foil.

In the case of table rolls, the force causing deflection of the fabric increases in intensity with increasing machine speed, and eventually, at high speeds, acts to the detriment of paper quality. In the case of foils, the same condition persists but is controllable to a greater degree by simply decreasing the drainage angle of the foil or altering blade width and spacing. However, on low speed machines it is often difficult to obtain adequate agitation by using foils.

SUMMARY OF THE INVENTION

The present invention overcomes the disadvantages described in the following manner.

In a stretch of the dewatering path of the layer of pulp stock where the fibers are still in suspension, the layer is subjected to light suction, e.g. negative air pressure under the layer and positive pressure above the layer, and, at the same time, to up and down agitation thus providing a vertical pulsating action to break up flocs or agglomerations of fibers present in the stock. This can be accomplished by running the forming fabric, in a section normally occupied by table rolls or foil units, over one or more low vacuum slotted type suction boxes in which means is provided for undulating the forming fabric. Such means may include a plurality of spaced-apart supporting elements for the fabric, in which at least one element is at a lower level than the others. It should be understood that the low vacuum suction box does not replace a conventional suction box or boxes, normally placed downstream of the usual series of foils or table rolls, ahead of the couch roll.

The fabric, in its travel, moves up and down as it passes over the supporting elements at different levels. Because of the speed at which the fabric is moving, a "roller coaster" effect is produced by which the stock is subjected to a tossing action. This reduces the tendency of the fibers to remain oriented horizontally so as to form lamina in the stock. The vertical agitation tosses the fibers end for end vertically interlacing them through the depth of the sheet rather than allowing them to remain horizontally disposed. Preferably, each alternate element, in a series, is at a lower level than its neighbours.

One way of implementing the invention is by substituting for one or more groups of table rolls or foil units a modified version of a slotted type suction box. For example, a suction box of the type described in British Pat. No. 1,285,532 may be used. A feature of the suction box shown in the British patent is that the cover is made up of fabric-supporting blades extending cross-wise of the machine that are replaceably mounted on rails by means of T-connections, as shown in the drawing, FIG. 1.

In the conventional suction box having a slotted cover, the support surface comprises bar-like members or blades each having a flat top fabric-supporting surface which invariably lies in the same parallel plane as the forming fabric and over which the fabric slides. The blades are usually spaced closely enough together so that, when in operation under normal running tension, and with a vacuum maintained in the box sufficient for drainage requirements, deflection of the forming fabric as it passes from one blade to the next blade is insignificant.

The tension on the forming fabric is usually such that it is just tight enough so that it does not slip on the drive roll. The tension is influenced by the drag introduced by the various dewatering components, for example the suction in the suction boxes, the number of foils and their dewatering capacity, and so on. While the tension may be high, up to about 70 pounds per lineal inch at the couch roll, it can drop off to about 30 pounds per lineal inch on the return section. The precise tension in the forming section, where the low vacuum box is placed will be somewhere between 30 and 70 pounds per lineal inch and will depend on the operating conditions of the machine.

With the apparatus of the present invention, it has been found that, if a blade intervening two other blades in the box cover is lowered by a small amount, and the suction box is placed in a zone where the fibers are still in suspension in the stock, deflection of the forming fabric will occur to cause vertical agitation of the stock with improved fiber distribution. Preferably, alternate blades in a series are lowered by a small amount relative to the other blades. Further, by adjusting the width and elevation of top surfaces of the lowered blades, drainage can be controlled to the desired degree.

In the present invention, the height of the lowered blade or blades will depend on fabric tension, on the vacuum in the suction box, and on the span between supporting blades. Preferably the height of a lowered blade will be set so that the fabric will just clear its top surface and a layer of water adhering to the bottom surface of the fabric will combine with water on the blade's top surface to form a fluid seal, as described elsewhere herein; accordingly, suction-acceptable gaps are provided between the blades in which the forming fabric is substantially unsupported.

The arrangement described promotes slight sagging of the forming fabric between supporting blades which, in effect, causes the fabric to undulate vertically in a modified roller coaster manner as it passes over the suction box. At normal operating speeds of the paper machine and normal operating tension of the forming fabric, this undulation is rapid and, while not of great vertical amplitude, causes rapid vertical pulsation in the stock on the fabric which tends to break up and disperse fibers which have become agglomerated. The vertical agitation has the effect of imparting a differential velocity to the respective ends of the fiber causing the fibers to be up-ended and to tumble, rotate and mix together throughout the layer rather than to remain horizontal and laminate. At the same time the differential pressure on the top and bottom of the stock created by the suction draws water from the stock and also pulls the fabric downwards. A feature of the invention is that, as well as inducing vertical pulsation in the stock, the drainage of the stock in the pulsating zone can be controlled. At the same time, the arrangement is such as to prevent excessive sagging of the fabric in the pulsating zone at normal operating fabric tension. The latter would cause increased wear on both the fabric and the support bars and undue power consumption.

BRIEF DESCRIPTION OF THE DRAWINGS

The invention will be better understood by the following description and the accompanying drawings illustrating preferred apparatus, in which.

DESCRIPTION OF THE PREFERRED EMBODIMENTS

Figure 1:
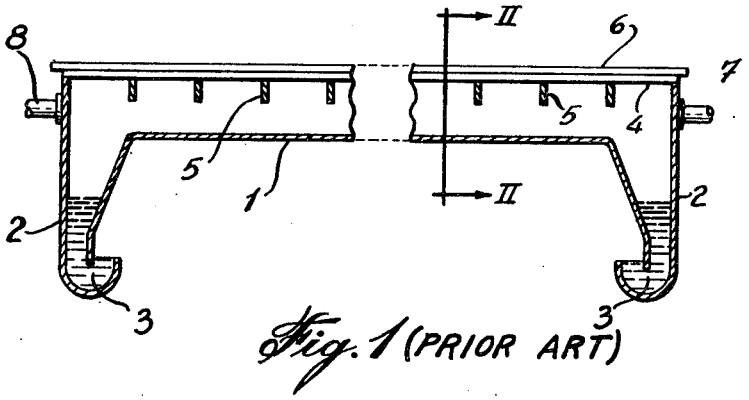
Fig. 1 (PRIOR ART)
FIG. 1 is a transverse sectional view of a conventional slotted type paper machine suction box having fabric supporting blades mounted on T-bars.
Figure 2:
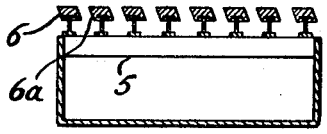
Fig. 2 (PRIOR ART)
FIG. 2 is a vertical cross-section along the line 2—2 of FIG. 1.
Figure 3:
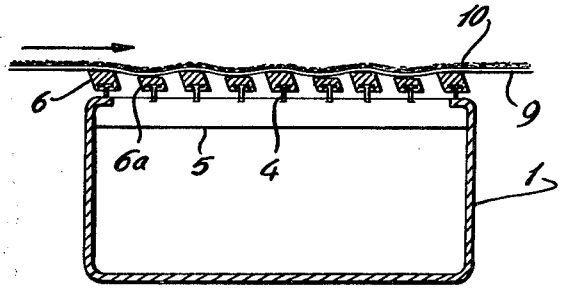
FIG. 3 is an enlarged cross-sectional view of the same box as in FIGS. 1 and 2 with alternate fabric support blades set at different levels according to the present invention.
Figures 4, 5, 6, 7, 8, 9:
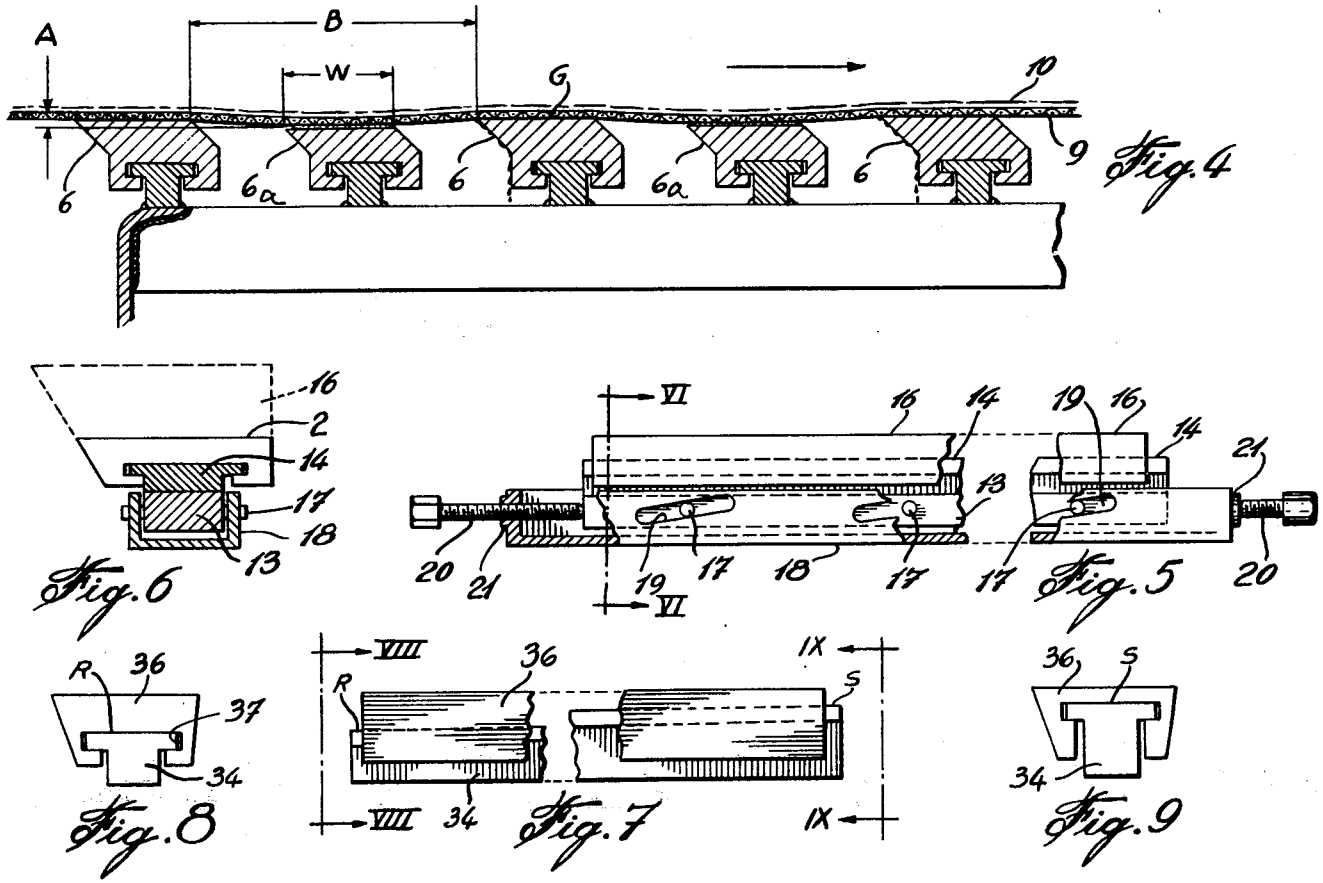
FIG. 4 is a greatly enlarged fragmentary cross-sectional view of the box shown in FIG. 3, showing in greater detail the way in which the support blades are positioned relative to the operating Fourdrinier fabric and alternate blades.
FIG. 5 is a fragmentary side elevation partly in section showing an alternative construction providing for vertical adjustment of blades.
FIG. 6 is a vertical cross-section along the line 6—6 of FIG. 5.
FIG. 7 is a fragmentary side elevation showing an alternative construction providing for vertical adjustment of the blade on the T-bar.
FIG. 8 is an end elevation from the left hand end of the construction shown in FIG. 7.
FIG. 9 is an end elevation from the right hand end of the construction shown in FIG. 7.

Referring to FIGS. 1 and 2, the body structure of the conventional suction box is denoted by numeral 1. Numeral 2 denotes integral downcomers located at each end of the box in which a head of water is maintained depending upon the vacuum within the box. The downcomers 2 are provided with drainage traps 3 through which water that has been withdrawn from the pulp stock is removed from the system. The suction box 2 includes a slotted cover including T-bars 4 which are mounted lengthwise of the box on cross members 5 in such a way that they are spaced in a horizontal plane parallel to the fabric when it is at rest. The fabric support blades are shown at 6 and each of these is provided with a T-shaped recess in its bottom surface so that it may be slid endwise onto a corresponding T-bar and held firmly in position in the manner shown and described for the attachment of foils in British Pat. No. 1,084,909. The blades 6 are made of a material which resists wear by the fabric and which, in turn, provides support for the fabric with a minimum of friction. A commonly used material for these blades is high density, high molecular weight polyethylene. The top surfaces G of the blades lie in the plane of the Fourdrinier fabric and the blades are spaced parallel to one another to form a supporting grid through which water may be withdrawn from the pulp without causing appreciable deflection of the forming fabric into the slots between the blades; as illustrated in FIGS. 3 and 4. At 7 is shown a pipe leading from the interior of the box through an adjusting valve (not shown) to the vacuum source and at 8 a pipe leading to a bleed valve for controlling vacuum within the suction box.

Suction boxes according to the above mentioned British Pat. No. 1,285,532 range in width (in the machine direction illustrated by the direction of arrows of FIGS. 3 and 4) between 24" and 42". The standard support blades have a top surface $1\frac{3}{8}$" or $1\frac{3}{4}$" wide and the blades are spaced, centerline-to-centerline at 3 inches, 4 inches or 6 inches. Thus from the trailing edge of one blade to the leading edge of the next downstream blade, the distance could be from $1\frac{1}{4}$" to $4\frac{1}{4}$". The number of blades could vary from 3 to 6 in a small (24 inch) suction box and from 7 to 14 in a large (42 inch) suction box. The vacuum may range from slightly more than zero up to over 40 inches of water depending on the grade of paper being produced.

In cases where heavier blade wear is encountered and the blades are made, for example, of polyethylene or like material it would be preferable to provide these with inserts of hard wearing material as shown in British Pat. No. 1,160,699 to extend their operating life.

In accordance with the invention, at least one of the support blades 6a of a conventional suction box, as described above, is made so that its generally planar top surface lies in a horizontal plane below the general level of the other blades and thus below the undersurface level of the forming fabric. It should be stressed, however, that also in accordance with the invention, this suction box is placed in the dewatering section of the machine, where the fibers are still in suspension. In the embodiment of the invention as shown in FIGS. 3 and 4, alternate blades 6a have been lowered by a distance A and the increased span between supporting blades 6 has permitted the forming fabric to sag under its own weight plus the weight of the pulp stock and under the influence of the vacuum when the machine is running. As seen in FIGS. 3 and 4, suction-accessible gaps are provided between the blades in which the forming fabric is substantially unsupported. The distance A depends upon the amount of sag of the fabric when the machine is operating and, ideally, is contrived so that at the lowest point of sag between the support blades 6 the fabric will just clear the top surface of the lowered blades 6a and the layer of water adhering to the bottom of the fabric will form a fluid seal with water on the lowered blades so that the grid area of the drainage surface influenced by vacuum in the suction box will remain substantially unchanged. Preferably the surfaces of the lower level blades do not actually contact the fabric. So, in effect, the surface of a lower level blade acts as a sealing surface rather than a supporting surface in that water is retained between the sealing surface and the water adhering to the bottom surface of the forming fabric. Thus, vacuum is not applied to the under surface of the fabric which is in contact with the seal thus formed at the surface of blades 6a. The normal deckles intervene the blades at each end of the suction box also making contact with the wire to provide the required seal for effective suction. It will be understood that the level of blades 6a must not be appreciably lower than the normal sag of the fabric for it is preferable that the fluid seal between the fabric and the lowered blades is not broken.

While the supporting blades have been shown equally spaced there may be circumstances under which variable spans are desirable between the supporting blades. For example, in the initial part of the suction box, the blades might be more widely spaced apart than at the latter part, so as to provide greater agitation during initial treatment.

In cases where there are variable spans between the supporting blades there may also be correspondingly variable differences in elevation of the lower blades. For example, if the span is increased between two supporting blades and other factors remain substantially unchanged, the fabric will have tendency to sag more between these blades and the intervening blade may be lowered a greater amount.

Referring to FIG. 4, the difference in elevation A between supporting blades 6 and lowered blades 6a depends upon a number of variables among which are the following:

Span B between supporting blades.
Operating fabric tension.
Vacuum load.
Pulp and fabric load.
Stiffness of the fabric.

While the paper machine is operating under stable conditions the variables listed are constant enough to warrant determination of A by calculation, and, while it is feasible to set distance A within empirically detemined limits, depending on operating conditions, preferred settings are where the difference in elevation A is between 0.005 inch and 0.100 inch, span B is between 1 inch and 20 inches and the width of the lowered support blade W is between ¼ inch and 5 inches. The vacuum maintained in the box may range from about 1 inch and 30 inches of water.

It is also within the scope of the invention that two or more consecutive blades may be lowered to increase the span between supporting blades if so warranted by operating conditions on the paper machine.

The invention lends itself to the use of the preferred T-rail method of attachment of the fabric supports to afford versatility in obtaining the desired agitation of the stock since the configuration of the bearing surfaces of the suction box may be quickly and easily altered by simply sliding blades of different dimension off and on the T-rail supports. While the T-rail method of attachment is preferred for the reasons outlined above, other methods of attachment may be used within the scope of the invention.

An alternative expedient known generally in the art for adjusting the elevation of the lowered support blades is a simple adjustable T-bar device as shown in FIG. 5. Referring to FIG. 5, numeral 14 is the T-bar which holds blade 16 and is attached with countersunk screws (not shown) to rectangular bar 13 which has the same width as the vertical part of the T. Bar 13 has holes drilled about every 6 to 8 inches along its length to accommodate pins 17 which project on either side. The extended T assembly is mounted in channel 18 which has in its vertical sides sloping slots cut as shown at 19, the T-assembly being supported in the channel by the pins 17 which extend into the slots 19 so that there is some clearance between the top edges of the channel 18 and blade 16 and a similar clearance between bar 13 and the bottom of channel 18. Set screws 20 are threaded into end-pieces 21 of the channel and, as will be understood from FIG. 5, as the T-assembly is adjusted lengthwise in the channel by means of the set screws it will be raised or lowered as the pins 17 slide upwards or downwards in the slots 19.

Another expedient for adjusting the elevation of the lower support blade is to provide the blade with a longitudinally sloping T-recess and the T-bar with a corresponding longitudinal slope is shown in FIGS. 7, 8 and 9.

Referring more specifically to FIGS. 7, 8 and 9, a T-bar 64 extends across the machine, slideably mounting a foil blade 36. The T-bar 34 engages in a complementary T-recess 37 in the blade 36. The T-bar is vertically inclined slightly in the cross direction of the machine providing, in effect, a ramp. The T-recess is correspondingly inclined so that when the blade is seated on the T-bar its surface is always horizontal. Vertical adjustment of the height of the blade may be accomplished by sliding it along the T-bar, so that it rides up or down the ramp surface of the T-bar, for example between the levels indicated as R and S on the drawing. The dimensions of the recess 37 and the T-bar are such as to provide a snug fit so that once placed the blade does not move relative to the T-bar. If desired, a locking mechanism may be employed to positively anchor the blade against movement relative to the T-bar.

In a typical preferred construction, the slope of the T-bar ramp surface is 0.03 inch per foot. Thus in 25 feet the difference between R and S would be 25 × 0.03 inch - 0.75 inch. Thus, sliding the blade along the T-bar a distance of one foot to the right would elevate the support surface $G_2$ a distance of 0.03 inches.

I claim:

1. A process for improving stock formation on a paper-making machine comprising a forming-fabric passing through a dewatering zone, comprising the steps of:

(A) discharging an aqueous paper-making suspension of fibers onto the forming fabric in a substantially horizontal plane while supporting the fabric at spaced apart zones transverse to the direction of the travel of the fabric and permitting the fabric to sag in gaps between the supported zones and forming vertical fabric undulations in said gaps, (B) providing water-seal forming means intermediately of the gaps in a plane below where the fabric is supported to interrupt the suction in said dewatering zone; and (C) applying suction in said gaps to the underside of the fabric to draw the fabric downwardly between the gaps, the suction applied in each gap being interrupted by said water-seal forming means as the aqueous paper-making suspension of fibers is dewatered and the fibers are interlaced.

2. The process as defined in claim 1, including maintaining a vacuum in the suction box within the range from 1 inch to 30 inches of water.

3. Apparatus for improving stock formation on the forming fabric of a paper-making machine, comprising, a suction box located in a dewatering zone of the forming section of the paper-making machine where the fibers are in suspension on the forming fabric, said suction box having a slotted type fabric-supporting cover including a plurality of spaced-apart elongated blades defining a suction box grid area, each blade mounted on a blade support and having a top surface, the blades including at least one upstream blade and one downstream blade having fabric-supporting surfaces which lie in a plane parallel to the general plane of travel of the forming fabric, the top surface of at least one blade intervening any two fabric-supporting blades being at a lower level to permit the fabric to undulate and agitate the stock without substantially changing the suction box grid area, said top surface at least forming a water seal between it and the undersurface of the fabric, each lower level blade being slidably attached to a T-rail blade support having a ramp sloping at about 0.03 inches per foot which engages in a complementary T-recess sloping lengthwise in the blade whereby the blade may be slid along the T-rail blade support to effect its vertical adjustment.

4. An apparatus for improving stock formation on the forming fabric of a paper-making machine, comprising, a suction box for location in the dewatering zone of the forming section of the paper-making machine where the fibers are in suspension, said suction box having a slotted type fabric-supporting cover comprising a series of spaced apart, forming fabric-supporting blades having generally planar top surfaces transverse to the direction of travel of the fabric in a common essentially horizontal plane providing therebetween suction-accessible gaps in which the forming fabric is substantially unsupported and is drawn downward to form stock-agitating undulations in said gaps, said cover including water seal-forming blades disposed intermediately in said gaps between the fabric-supporting blades and having top surfaces transverse to the direction of travel of the fabric at a lower level than the top surfaces of the fabric-supporting blades and at least forming water seals at the downward undulations of the forming fabric thereby interrupting the suction temporarily to limit drainage while causing vertical agitation of fibers on the fabric passing through the dewatering zone.

5. Apparatus, as defined in claim 4, in which the lower level blades are set so that their top surfaces are within the range from 0.005 inches to 0.100 inches below the level of the surfaces of the fabric-supporting blades.

6. Apparatus, as defined in claim 4, in which the width of the lower level blades is within the range from ¼ inch to 5 inches.

7. Apparatus, as defined in claim 4, in which the span between fabric supporting blades in the essentially horizontal plane is within the range from 1 inch to 20 inches.

8. Apparatus, as defined in claim 4, in which the lower level blades are slideably attached to T-rail blade supports.

* * * * *

UNITED STATES PATENT AND TRADEMARK OFFICE

CERTIFICATE OF CORRECTION

PATENT NO. : 4,140,573

DATED : February 20, 1979

INVENTOR(S) : Henry Johnson

It is certified that error appears in the above-identified patent and that said Letters Patent are hereby corrected as shown below:

Column 3, line 29, change "suction-acceptable" to --suction-accessible--.

Column 6, line 56, change "64" to --34--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*